United States Patent [19]

Beaverson

[11] Patent Number: 5,040,463

[45] Date of Patent: Aug. 20, 1991

[54] PRESSURE ACTIVATED POWER SUPPLY

[75] Inventor: Lowell D. Beaverson, Plymouth, Minn.

[73] Assignee: Alliant Techsystems Inc., Edina, Minn.

[21] Appl. No.: 413,949

[22] Filed: Sep. 28, 1989

[51] Int. Cl.[5] ..... F42C 11/02

[52] U.S. Cl. ..... 102/210; 89/28.1

[58] Field of Search ..... 102/210, 207, 275.11; 89/28.1

[56] References Cited

U.S. PATENT DOCUMENTS

| | | | |
|---|---|---|---|
| 2,827,851 | 3/1958 | Ferrara | 102/210 |
| 2,970,545 | 2/1961 | Howe | 102/210 |
| 3,295,449 | 1/1967 | Lohnert | 102/210 |
| 3,589,294 | 6/1971 | Stresau | 102/210 |
| 3,859,746 | 1/1975 | Pecksen | 89/28.1 |
| 3,954,061 | 5/1976 | Rudenauer et al. | 102/70.2 |
| 3,967,556 | 7/1976 | Post et al. | 102/70.2 |
| 3,976,898 | 8/1976 | Newson | 102/210 |
| 3,987,729 | 10/1976 | Andrews et al. | 102/22 |
| 4,510,844 | 4/1985 | Fritz et al. | 89/135 |

FOREIGN PATENT DOCUMENTS

| | | | |
|---|---|---|---|
| 2206646 | 8/1972 | Fed. Rep. of Germany | 102/210 |

OTHER PUBLICATIONS

Webster, Webster's New International Dictionary, 6/22/50, p. 12.

*Primary Examiner*—Deborah L. Kyle
*Assistant Examiner*—Stephen Johnson
*Attorney, Agent, or Firm*—Kinney & Lange

[57] ABSTRACT

A device for use in a weapon system provides electrical energy for fuzing the weapon system. The device includes a detonator disposed within a housing, with the detonator being in association with a piezoelectric element such that upon detonation, the piezoelectric element is exposed to sufficient pressure to produce electrical energy. A firing pin mechanism is detachably attached within the housing in a pre-detonation position and is capable of detachment at a selected pressure and movable after detachment to a detonation position, detonating the detonator for the production of electrical energy.

5 Claims, 1 Drawing Sheet

PRESSURE ACTIVATED POWER SUPPLY

BACKGROUND OF THE INVENTION

1. Field of the Invention

The present invention relates to a pressure actuated device for providing an electric current to fuze a weapon system through the use of a piezoelectric element.

2. Description of the Prior Art

Piezoelectric elements have been used in weapon and ammunition systems for quite some time.

The Andrews et al U.S. Pat. No. 3,987,729 describes a device for firing an electric detonator which includes a bellows element and a ceramic piezoelectric element, both disposed within a housing. The piezoelectric element is positioned between an anvil element connected to the housing and a hammer element that is connected to one end of the bellows. When a shock wave is generated, the pressure causes the bellows to extend and through the hammer element to compress the piezoelectric element against the anvil element.

The Post et al U.S. Pat. No. 3,967,556 describes a pneumatic point detonating fuze in which piezoelectric elements operate in conjunction with a trigger circuit to provide a firing signal at impact.

The Rudenauer et al U.S. Pat. No. 3,954,556 describes a device for an electrically operable projectile in which a primer pin in the form of a firing pin is axially displaceable in the projectile, while a detonator cap near one end of the primer pin is adapted to be ignited by impact of the primer pin thereon. A spring biases the primer pin away from the detonator cap, while a propelling charge near the other end of the primer pin is electrically ignitable to drive the primer pin into impact with the detonator cap. The primer pin is latched in the projectile with the spring compressed and rotation of the projectile in flight will release the latch. When the primer pin is released, it bridges a pair of contacts and completes a circuit from a piezoelectric crystal through the propelling charge where the projectile will detonate upon impact by igniting the propelling charge and driving the primer pin into impact with the detonator cap. The detonator cap moves into registration with the primer pin in response to rotation of the projectile in flight.

The Fritz et al U.S. Pat. No. 4,510,844 describes an electrical firing mechanism for handguns and small caliber machine guns having a tension trigger which tightens a compression spring locating an impact member which when released strikes a piezovoltage generator. The output of the generator leads to an electrical detonator.

SUMMARY OF THE INVENTION

The present invention includes a device for use in a weapon system that provides electrical energy for use in fuzing the weapon system. The device includes a piezoelectric element and a detonator positioned within a housing such that upon detonation, the piezoelectric element is exposed to resulting shock wave so that a current is produced for use in fuzing the weapon system. A firing pin mechanism is detachably attached within the housing in an initial pre-detonation position and is acted upon by an external force, such as pressure generated by propulsion gases, to move and detonate the detonator.

DETAILED DESCRIPTION OF THE PREFERRED EMBODIMENTS

Figure 1:
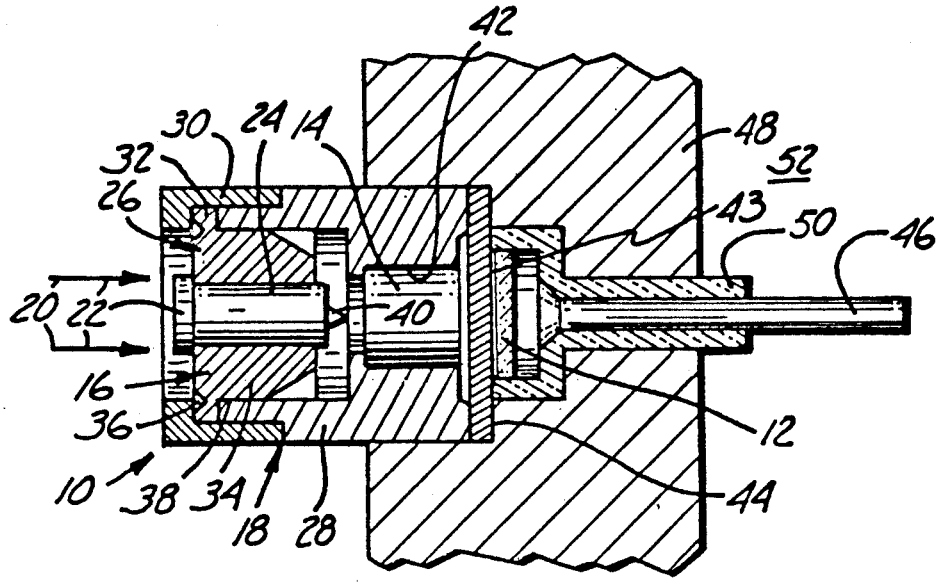
FIG. 1 is a cross-sectional view of the device of the present invention in a pre-detonation position.
Figure 2:
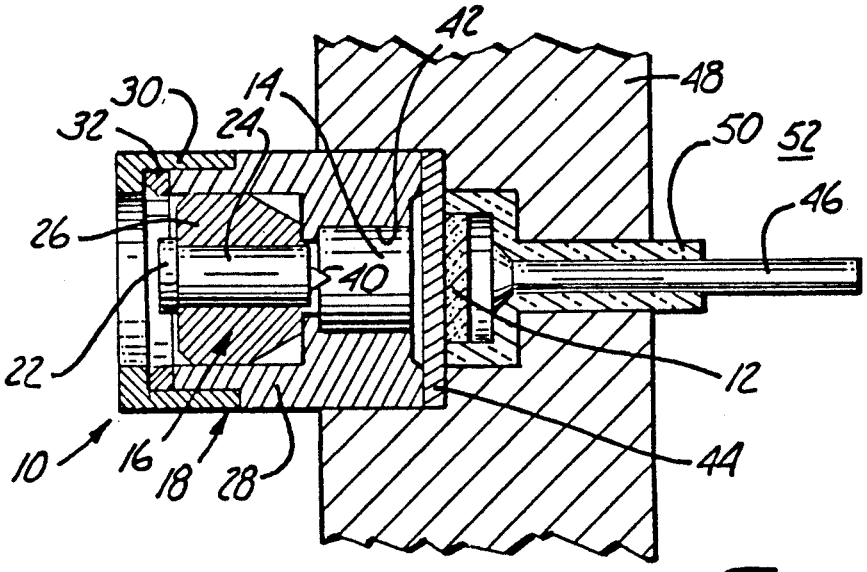
FIG. 2 is a cross-sectional view of the device of FIG. 1 in a detonating position.

A device of the present invention is generally indicated at 10 in FIG. 1. The device 10 provides a reserve power supply and has an unlimited storage life. The device is a low cost alternative to prior art reserve or active batteries or inductive generators. The device utilizes high pressure gas of a propulsion system of the weapon system (not shown) to provide the low cost reserve electrical power.

The device 10 includes a piezoelectric element 12, a stab detonator 14, and a firing pin mechanism 16. A housing 18 encompasses the detonator 14 and the firing pin mechanism 16. The piezoelectric element is positioned in association with the detonator 14 such that upon detonation, forces from the detonator 14 will act on the element 12 to produce sufficient electrical energy for fuzing the weapon system (not shown).

The present invention is particularly useful in weapon systems in which high pressure gases are generated, such as from a propulsion system. In the embodiment illustrated in FIG. 1, high pressure from propulsion gases, indicated by arrows 20 are exerted on a backside 22 of the firing pin mechanism 16.

The firing pin mechanism 16 includes a steel firing pin member 24 disposed within a firing pin block 26. The firing pin block 26 includes an annular flange portion 32 and a firing pin holder portion 34.

The housing 18 includes a detonator holder portion 28 and a sealing ring 30. The sealing ring 30 engages the flange portion 32 and retains it against the detonator holder 28 such that the firing pin mechanism is held in a stationary position within the housing 18.

The firing pin block 26 of the firing mechanism 16 is made from a material having good fracture properties. In addition to good fracture properties, the material must have sufficient integrity to keep the portion 34 whole under high pressure. In one working embodiment, a phenolic material is used to provide the desired properties and is shearable at approximately 1,500 psi. To aid in control of fracture or shearing the flange portion 32 from the firing pin holder portion 34, an annular v-shaped groove 36 is included on a rearward side of the firing pin mechanism. The annular groove 36 is circumferentially aligned with an inner edge of an annular shoulder of the detonator holder 28 such that a clean break of the firing pin holder portion 34 from the flange 32 occurs when subjected to a selected high pressure.

After shearing, the firing pin 24 is moved forwardly by the force of the high pressure gas and impacts the detonator 14 with a forwardly disposed pointed end portion 40. The detonator 14 is retained within the detonator holder 28 in a chamber 42 such that when detonation occurs, the resulting shock wave is directed toward the piezoelectric element 12.

The piezoelectric element 12 is disposed between a load bearing and conductive plate 44 and a conductive terminal 46. The plate 44 acts to transmit the shock wave and distribute the resulting force across the piezoelectric element to produce electrical energy.

The piezoelectric element 12 and the plate 44 are spaced apart in a predenotation position as indicated by gap 43 in FIG. 1. The gap 43 prevents accidental fuzing due to an inadvertent jolt to the device by spacing the element 12 from the plate 44. A gap of approximately 0.002 to 0.003 inches has been found to be sufficient to prevent accidental fuzing in one working embodiment while still positioning the plate 44 and the element 12 so that the shock waves from the detonation are transmitted and electrical contact established between the plate 44 and the element 12.

The terminal 46, the piezoelectric element 12, the plate 44 and the detonator holder 28 of the housing 18 are secured within a bulkhead 48. An insulator 50 made of a material such as phenolic or polycarbonate insulates the terminal 46 and the piezoelectric element 12 from the bulkhead 48. The plate 44 touches the bulkhead 48 such that current is conducted from the plate 44 to the bulkhead 48. The bulkhead 48 and conducting plate 44 provide a return ground path to the piezoelectric element 12.

A preferred piezoelectric element is made from lead zirconate-lead titanate. However, it will be understood, that a suitable piezoelectric element will depend upon the electrical and mechanical properties needed for fuzing the weapon system and other piezoelectric materials that include such properties are within the scope of the present invention.

The electrical energy generated from the piezoelectric element 12 is conducted through the terminal 46. The terminal 46 is connected to a device to be activated (not shown), the device to be activated (not shown) is disposed on an opposite side 52 of the plate 48. The device to be activated (not shown) can be any one of a number of devices typically found in a weapon system that requires electrical energy for activation. For example, the terminal 46 can be directly connected to piston motors, detonators, squibs or the electrical energy generated can be stored in a capacitor for later use.

Although the present invention has been described with reference to preferred embodiments, workers skilled in the art will recognize that changes may be made in form and detail without departing from the spirit and scope of the invention.

What is claimed is:

1. A device for use in a weapon system provides an electrical energy for fuzing the weapon system, the device comprising:

a housing;

a piezoelectric element;

a detonator disposed within the housing and in association with the piezoelectric element such that upon detonation, the piezoelectric element is exposed to sufficient pressure to produce electrical energy; and a firing pin mechanism detachably attached within the housing in a pre-detonation position and being capable of detachment at a selected pressure and movable after detachment to a detonating position for detonating the detonator, the firing pin mechanism including a main shearable body portion and a retaining flange for retaining the firing mechanism in the pre-detonation position.

2. The device of claim 1 wherein the weapon system includes propulsion gases that generate pressure sufficient to move the firing pin mechanism into contact with the detonator, and wherein the firing pin mechanism further includes an annular groove disposed on a rearward side of the firing pin mechanism such that the firing pin mechanism selectively shears along the annular groove when exposed to the pressure of the propulsion gases.

3. The device of claim 1 wherein the piezoelectric element is disposed between a first conductive plate and a second conductive plate, with the first conductive plate also acting as a load bearing plate transmitting a detonating force from the detonator to the piezoelectric element.

4. A device for use in a weapon system provides an electrical energy for fuzing the weapon system, the device comprising:

a housing;

a piezoelectric element;

a detonator disposed within the housing and in association with the piezoelectric element such that upon detonation, the piezoelectric element is exposed to sufficient pressure to produce electrical energy;

a firing pin mechanism detachably attached within the housing in a pre-detonation position and being capable of detachment at a selected pressure and movable after detachment to a detonating position for detonating the detonator, the firing pin mechanism including a main shearable body portion and a retaining flange for retaining the firing mechanism in the pre-detonation position; and wherein the piezoelectric element is disposed between a first conductive plate and a second conductive plate, the piezoelectric element and the first conductive plate being spaced apart in the pre-detonation position with the first conductive plate also acting as a load bearing plate transmitting a detonating force from the detonator to the piezoelectric element.

5. The device of claim 4 wherein the weapon system includes propulsion gases that generate pressure sufficient to move the firing pin mechanism into contact with the detonator, and wherein the firing pin mechanism further includes an annular groove disposed on a rearward side of the firing pin mechanism such that the firing pin mechanism selectively shears along the annular groove when exposed to the pressure of the propulsion gases.

* * * * *